US010854950B2

(12) United States Patent
Sotoma et al.

(10) Patent No.: US 10,854,950 B2
(45) Date of Patent: Dec. 1, 2020

(54) ANTENNA DEVICE

(71) Applicant: TDK CORPORATION, Tokyo (JP)

(72) Inventors: Naoki Sotoma, Tokyo (JP); Tetsuya Shibata, Tokyo (JP); Yasuyuki Hara, Tokyo (JP)

(73) Assignee: TDK CORPORATION, Tokyo (JP)

( * ) Notice: Subject to any disclaimer, the term of this patent is extended or adjusted under 35 U.S.C. 154(b) by 163 days.

(21) Appl. No.: 15/906,799

(22) Filed: Feb. 27, 2018

(65) Prior Publication Data

US 2018/0254555 A1 Sep. 6, 2018

(30) Foreign Application Priority Data

Mar. 2, 2017 (JP) ..... 2017-038909

(51) Int. Cl.

| | |
|---|---|
| ***H01Q 3/38*** | (2006.01) |
| ***H01Q 13/10*** | (2006.01) |
| ***H01Q 1/48*** | (2006.01) |
| ***H01Q 9/04*** | (2006.01) |
| ***H01Q 1/22*** | (2006.01) |
| ***H01Q 25/00*** | (2006.01) |
| ***H01Q 21/28*** | (2006.01) |
| ***H01Q 21/06*** | (2006.01) |
| ***H01Q 3/36*** | (2006.01) |

(52) U.S. Cl.

CPC ..... *H01Q 1/2283* (2013.01); *H01Q 3/36* (2013.01); *H01Q 9/0457* (2013.01); *H01Q 21/065* (2013.01); *H01Q 21/28* (2013.01); *H01Q 25/00* (2013.01)

(58) Field of Classification Search

CPC ..... H01Q 23/00; H01Q 1/22; H01Q 9/0407; H01Q 3/38; H01Q 13/10; H01Q 1/48; H01Q 9/045; H01Q 1/2283; H01Q 25/00; H01Q 21/28; H01Q 21/065; H01Q 3/36; H01Q 9/0457

USPC ..... 342/371; 343/700 MS

See application file for complete search history.

(56) References Cited

U.S. PATENT DOCUMENTS

| | | | | |
|---|---|---|---|---|
| 2002/0122006 | A1* | 9/2002 | Crawford | H01Q 23/00 343/702 |
| 2014/0139385 | A1* | 5/2014 | Yoon | H01Q 9/0442 343/745 |
| 2016/0056544 | A1* | 2/2016 | Garcia | H01Q 1/38 343/725 |
| 2016/0134014 | A1* | 5/2016 | Hietala | H01L 23/66 342/371 |
| 2016/0134021 | A1 | 5/2016 | Helander et al. | |

(Continued)

FOREIGN PATENT DOCUMENTS

| | | |
|---|---|---|
| CN | 101409384 A | 4/2009 |
| JP | 2011-097526 | 5/2011 |

*Primary Examiner* — Peter M Bythrow
*Assistant Examiner* — Alexander L. Syrkin
(74) *Attorney, Agent, or Firm* — Young Law Firm, P.C.

(57) ABSTRACT

Disclosed herein is an antenna device that includes a substrate, an IC chip mounted on the substrate, a first antenna element including a plurality of patch antenna conductors that is supplied with power from the IC chip and that radiates a beam in a direction substantially perpendicular to the substrate, and a second antenna element that is supplied with power from the IC chip and that radiates a beam in a first horizontal direction substantially parallel to the substrate.

18 Claims, 9 Drawing Sheets

(56) References Cited

U.S. PATENT DOCUMENTS

2016/0172755 A1* 6/2016 Chen ..... H01Q 21/0025
342/371
2019/0334246 A1* 10/2019 Obata ..... H01Q 13/08

* cited by examiner

ANTENNA DEVICE

BACKGROUND OF THE INVENTION

Field of the Invention

The present invention relates to an antenna device, and particularly relates to an antenna device having a wide communicable angular range.

Description of Related Art

In recent years, frequency bands used in wireless communication of mobile electronic devices, such as smartphones, have been increasingly shifted to higher frequency bands. This shift causes a problem of loss attributed to the wiring length connecting a radiation conductor of an antenna device and an IC chip that supplies power to the radiation conductor. Japanese Patent Application Laid-open No. 2011-097526 discloses an antenna device that reduces the loss by mounting a radiation conductor and an IC chip on the same substrate in an overlapping manner to reduce the length of wiring connecting the radiation conductor and the IC chip.

However, the antenna device disclosed in Japanese Patent Application Laid-open No. 2011-097526 has a problem that beam radiation directions are limited to a range centered around a direction perpendicular to the substrate, because one or more patch antennas are formed on the substrate in a simple manner. Therefore, in a case of utilizing a frequency band in which directionality is required, for example, millimeter waves, there is a problem that communication is possible only within a narrow angle.

SUMMARY

It is therefore an object of the present invention to provide an antenna device with which communication is possible over a wider angle, even in a case of using a frequency band in which directionality is required.

An antenna device according to the present invention comprises a substrate, an IC chip mounted on the substrate, a first antenna element including a plurality of patch antenna conductors that is supplied with power from the IC chip and that radiates a beam in a direction substantially perpendicular to the substrate, and a second antenna element that is supplied with power from the IC chip and that radiates a beam in a first horizontal direction substantially parallel to the substrate.

According to the present invention, it is possible to perform communication over a wider angle, even in a case of utilizing a frequency band in which directionality is required, such as millimeter waves, because not only the first antenna element that radiates a beam in a direction substantially perpendicular to the substrate but also the second antenna element that radiates a beam in a direction substantially parallel to the substrate is included.

In the present invention, it is preferable that the patch antenna conductors be arrayed in one direction. Accordingly, the beam radiation direction can be controlled through phase control.

In the present invention, it is preferable that the substrate comprises a plurality of wiring layers including first and second wiring layers, the IC chip be mounted on the first wiring layer, and the first antenna element be formed in the second wiring layer so as to at least partially overlap the IC chip. Accordingly, the area of the substrate can be reduced.

In the present invention, it is preferable that the wiring layers further include a third wiring layer including a ground pattern, and the second antenna element be configured of a plurality of slot antennas respectively provided within a plurality of ground clearance regions that are cutouts of the ground pattern. Accordingly, it is possible to radiate beams in a direction parallel to the substrate, without increasing the thickness of the substrate.

In the present invention, it is preferable that the ground pattern includes first ground patterns respectively surrounding the ground clearance regions, and a second ground pattern surrounding the first ground patterns with slits therebetween. Accordingly, the gain of the second antenna element can be improved.

In the present invention, it is preferable that the slot antennas be arrayed in the one direction. Accordingly, the beam radiation direction can be controlled through phase control, also for the second antenna element.

The antenna device according to the present invention can further comprise an additional substrate connected to the substrate via a flexible substrate, and the second antenna element can include a plurality of additional patch antenna conductors that is supplied with power from the IC chip via the flexible substrate and that radiates a beam in a direction substantially perpendicular to the additional substrate. Connecting the two substrates via the flexible substrate in this manner enables the angle between the two substrates to be freely set.

In the present invention, it is preferable that the additional patch antenna conductors be arrayed in the one direction. Accordingly, the beam radiation direction can be controlled through phase control, also for the second antenna element.

In the present invention, it is preferable that the one direction be a second horizontal direction substantially parallel to the substrate and substantially orthogonal to the first horizontal direction. Accordingly, beams can be radiated in two directions by using a substrate of which the longitudinal direction is the one direction.

The antenna device according to the present invention can further comprise a third antenna element that is supplied with power from the IC chip and that radiates a beam in the second horizontal direction. Accordingly, because electromagnetic waves are radiated in three directions, it is possible to perform communication over an even wider angle.

As described above, according to the present invention, it is possible to perform communication over a wider angle even in a case of using a frequency band in which directionality is required, such as millimeter waves.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will now be explained in detail with reference to the drawings.

First Embodiment

Figure 1:
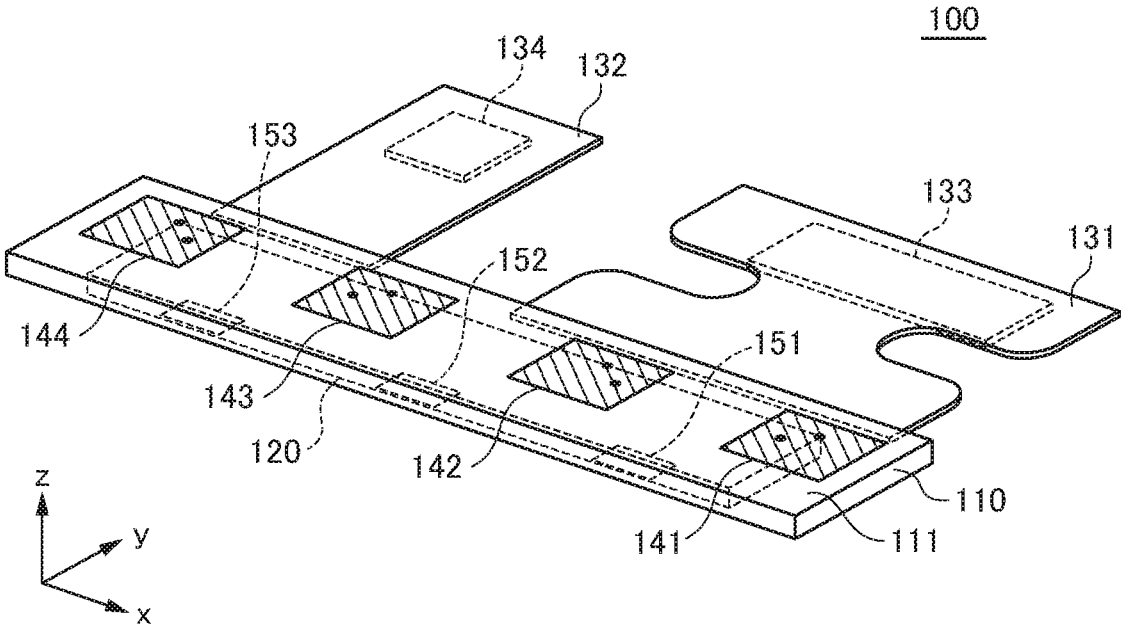
FIG. 1 is a schematic perspective view seen from the top side illustrating a configuration of an antenna device according to a first embodiment of the present invention.
Figure 2:
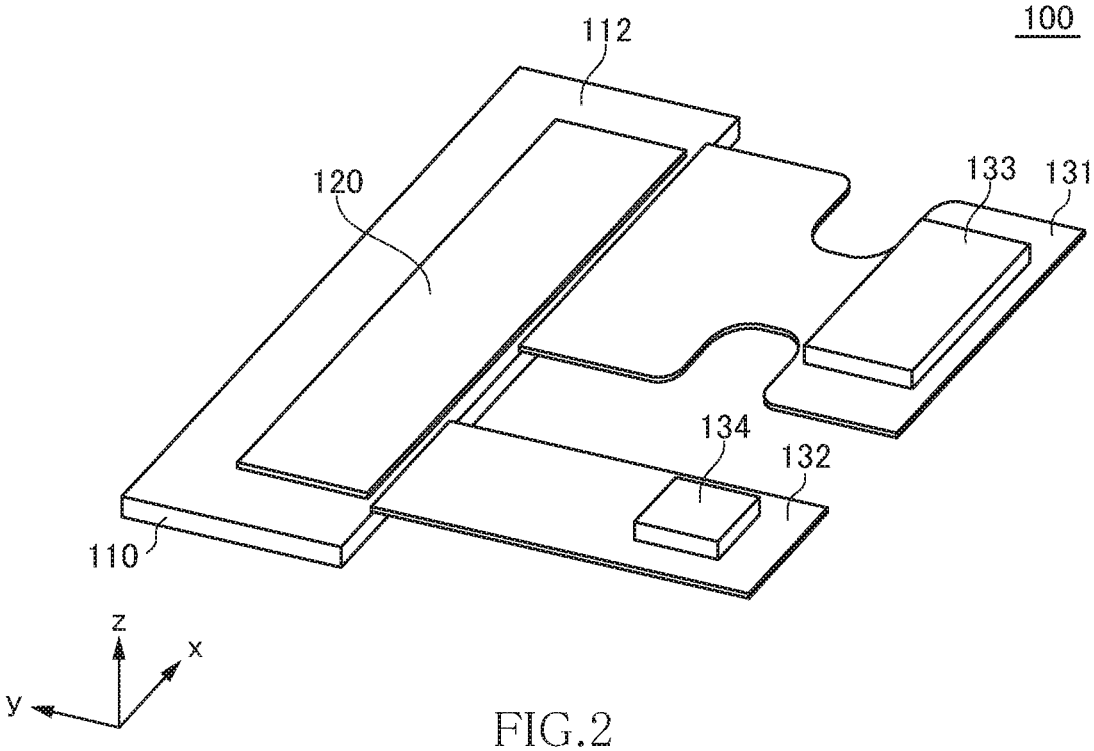
FIG. 2 is a schematic perspective view seen from the bottom side illustrating a configuration of the antenna device according to the first embodiment of the present invention.

FIGS. 1 and 2 are schematic perspective views illustrating a configuration of an antenna device 100 according to the first embodiment of the present invention. FIG. 1 is a view seen from the top side, and FIG. 2 is a view seen from the bottom side.

As illustrated in FIGS. 1 and 2, the antenna device 100 according to the present embodiment includes a substrate 110, an IC chip 120 mounted on the substrate 110, and flexible substrates 131 and 132 connected to the substrate 110. The substrate 110 is a multilayer substrate of which the longitudinal direction is the x-direction, the lateral direction is the y-direction, and the thickness direction is the z-direction. The substrate 110 includes a wiring layer 111 located at the top surface and a wiring layer 112 located at the bottom surface, as well as one or more internal wiring layers. The flexible substrates 131 and 132 are respectively mounted with connectors 133 and 134.

The wiring layer 111 located at the top surface of the substrate 110 is formed with four patch antenna conductors 141 to 144 arrayed in the x-direction. The patch antenna conductors 141 to 144 are supplied with power by the IC chip 120 and function as a first antenna element that radiates a beam in the z-direction. Through phase control of a power supply signal by the IC chip 120, it is possible to incline the beam radiation direction to the x-direction, with the z-axis as the center. The number of patch antenna conductors is not limited to four. However, in order to incline the beam radiation direction to the x-direction, it is necessary to use at least two patch antenna conductors.

The wiring layer 112 located at the bottom surface of the substrate 110 is mounted with the IC chip 120. In the present embodiment, the IC chip 120 also has a shape of which the longitudinal direction is the x-direction to be adapted to the shape of the substrate 110. The IC chip 120 is mounted in a position partly overlapping the patch antenna conductors 141 to 144. Accordingly, it is possible to reduce the planar size of the substrate 110, compared to a case of arranging the IC chip 120 and the patch antenna conductors 141 to 144 in different planes, respectively, in a non-overlapping manner.

Figure 3:
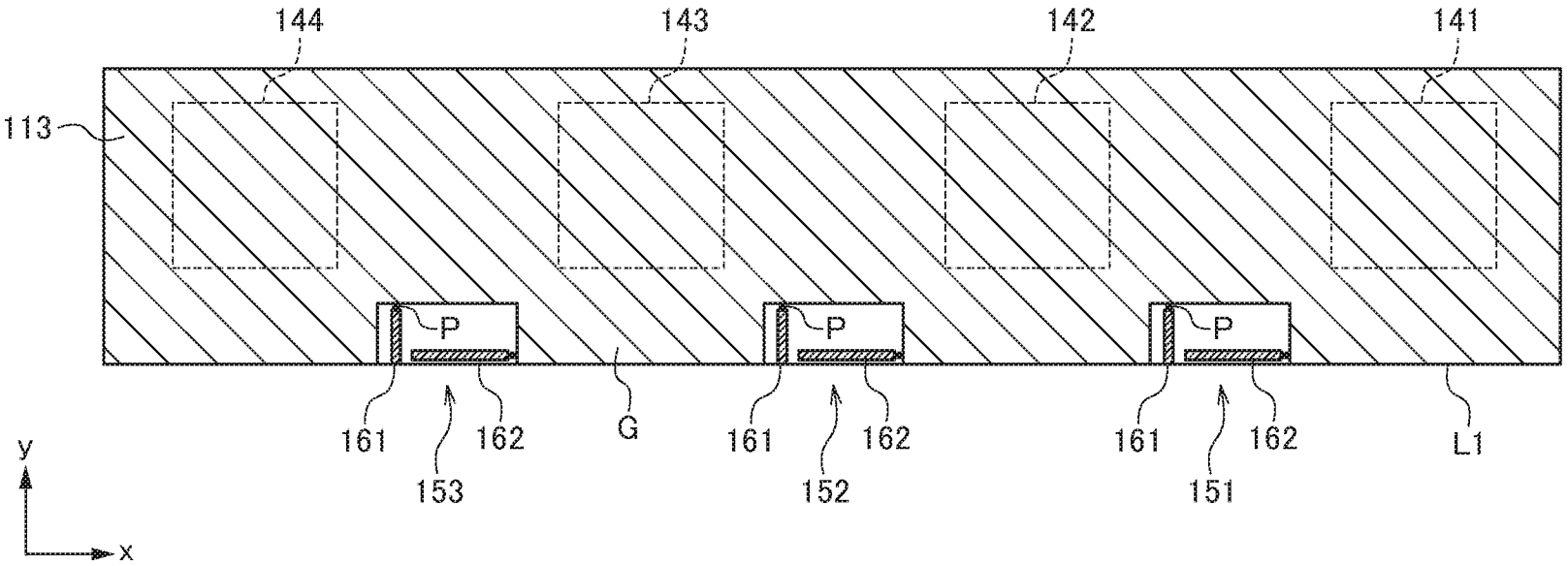
FIG. 3 is a schematic plan view illustrating a wiring layer.

Further, a wiring layer 113 illustrated in FIG. 3 is provided inside the substrate 110. In the wiring layer 113, a large-area ground pattern G is formed, and three ground clearance regions 151 to 153 are defined as partial cutouts of the ground pattern G along a long side L1 extending in the x-direction. Although not particularly limited, the ground clearance region 151 is arranged between the patch antenna conductors 141 and 142 when seen from the y-direction, the ground clearance region 152 is arranged between the patch antenna conductors 142 and 143 when seen from the y-direction, and the ground clearance region 153 is arranged between the patch antenna conductors 143 and 144 when seen from the y-direction.

As illustrated in FIG. 3, the ground clearance regions 151 to 153 are each formed with conductor patterns 161 and 162. The conductor pattern 161 is an elongated pattern extending in the y-direction and is arranged with an offset in the x-direction. One end of the conductor pattern 161 in the y-direction forms a power supply point P to which a power supply signal is supplied from the IC chip 120. The other end of the conductor pattern 161 in the y-direction is open at the long side L1. The conductor pattern 162 is an elongated pattern extending in the x-direction and is arranged near the long side L1 with an offset in the y-direction. One end of the conductor pattern 162 in the x-direction is connected to the ground pattern G, and the other end of the conductor pattern 162 in the x-direction is open.

The conductor patterns 161 and 162 have a predetermined inductance component, and a predetermined capacitance component is generated between the conductor patterns 161 and 162. Therefore, by adjusting the length, width, position, or the like of the conductor patterns 161 and 162, a slot antenna that resonates at a predetermined frequency is formed. A plurality of slot antennas thus formed function as a second antenna element that radiates a beam in the y-direction. Through phase control of a power supply signal by the IC chip 120, it is possible to incline the beam radiation direction to the x-direction, with the y-axis as the center. The number of slot antennas is not limited to three. However, in order to incline the beam radiation direction to the x-direction, it is necessary to use at least two slot antennas.

In this manner, the antenna device 100 according to the present embodiment includes the first antenna element (patch antennas) that radiates beams centered around the z-axis and the second antenna element (slot antennas) that radiates beams centered around the y-axis. Thus, when the same signals are output by the first antenna element and the second antenna element, beams propagating the same signals are radiated in both the z-direction and the y-direction. Therefore, it is possible to perform communication over a wider angle, even in the case of using a frequency band in which directionality is required, for example, millimeter waves.

In the present embodiment, providing the second antenna element does not increase the planar size of the substrate 110, because the second antenna element is formed in the wiring layer 113 located at an inner layer of the substrate 110.

Figure 4:
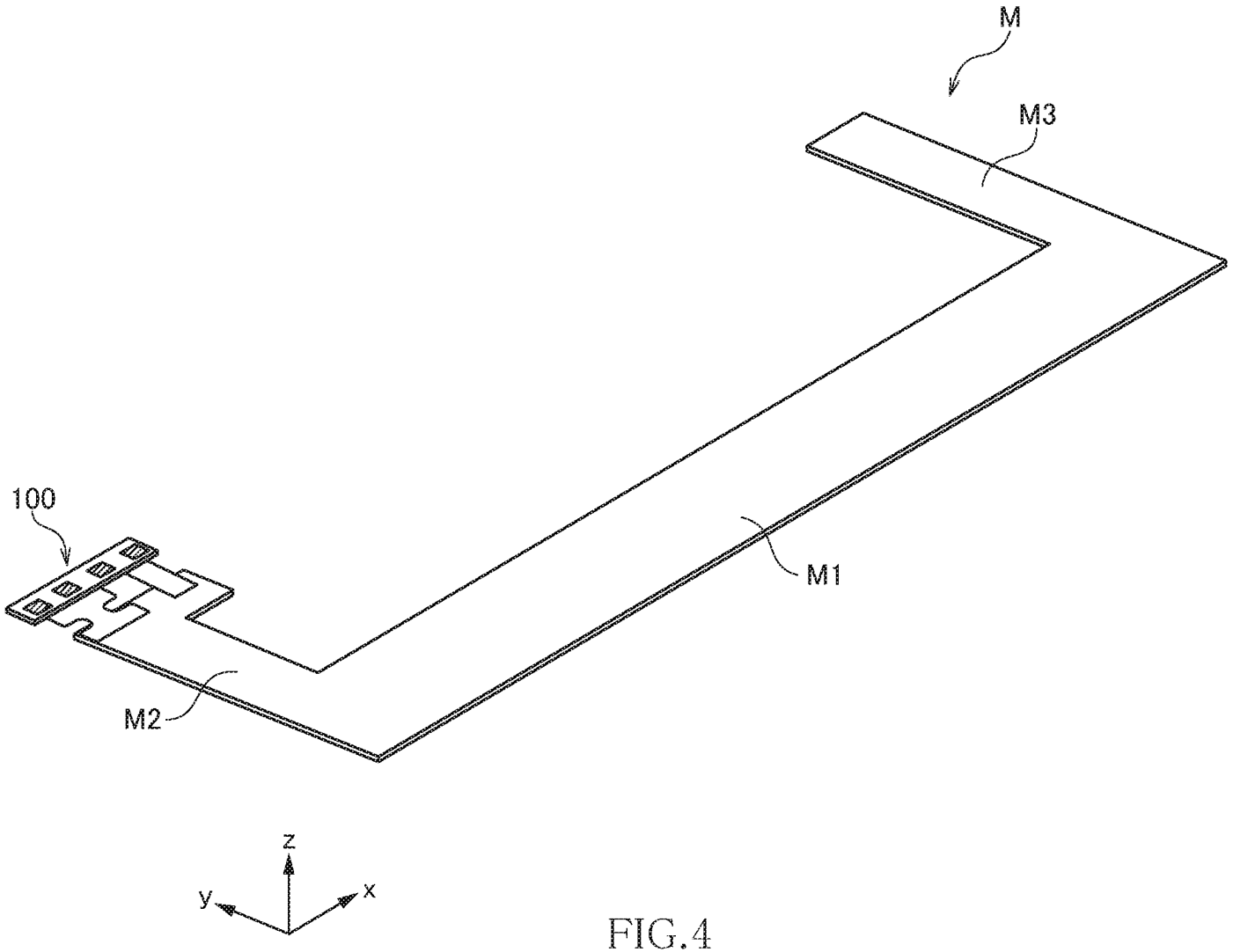
FIG. 4 is a schematic perspective view illustrating a state where the antenna device shown in FIGS. 1 and 2 is connected to a motherboard.

FIG. 4 is a schematic perspective view illustrating a state where the antenna device 100 is connected to a motherboard M. The motherboard M illustrated in FIG. 4 includes a first portion M1 extending in the x-direction and second and third portions M2 and M3 extending in the y-direction. The connectors 133 and 134 mounted on the flexible substrates 131 and 132 are connected to an end of the second portion M2. Connection to the motherboard M using these connectors 133 and 134 prevents the substrate 110, which is the main body of the antenna device 100, from overlapping the motherboard M. Therefore, it is possible to effectively utilize the surface of the motherboard M.

Figure 5:
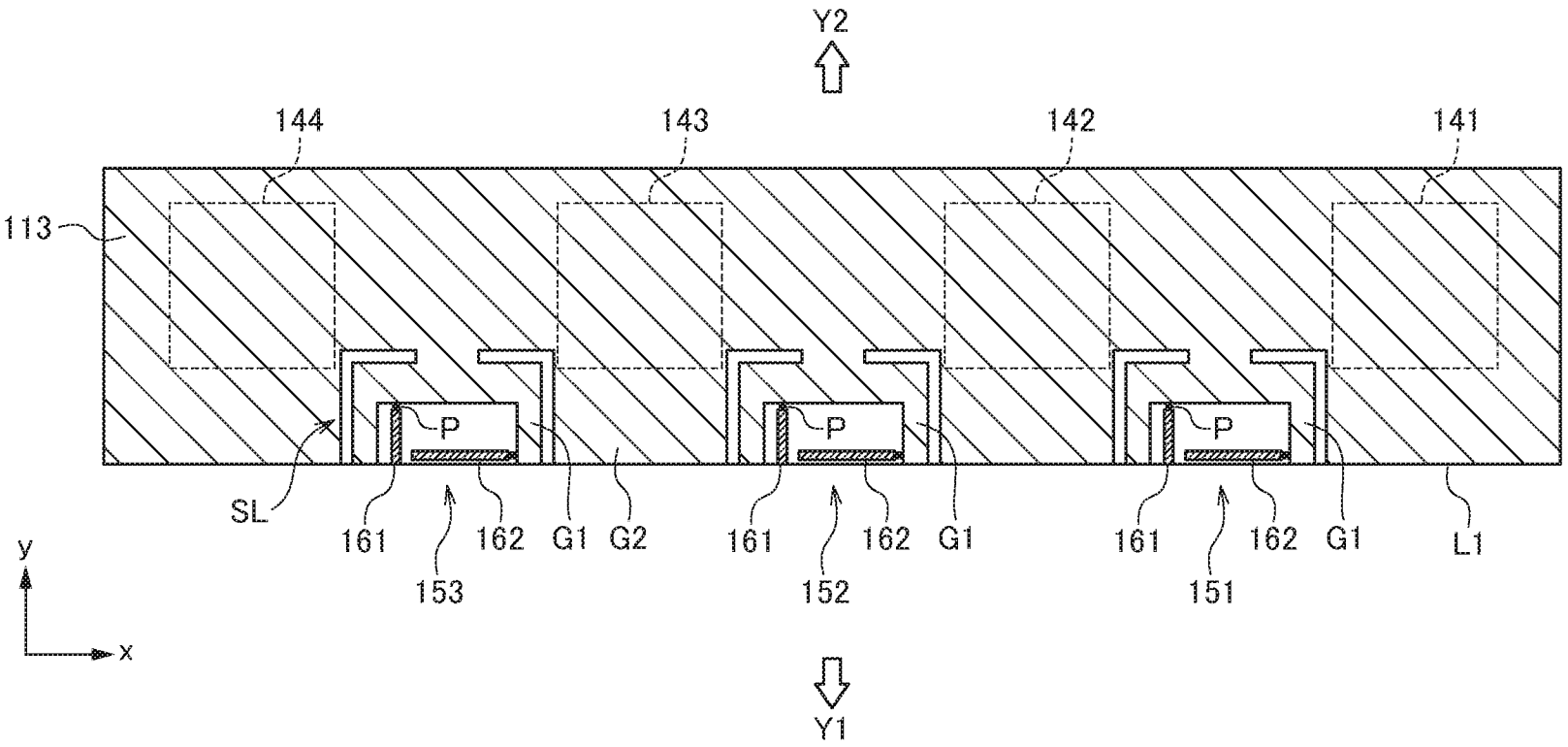
FIG. 5 is a schematic plan view illustrating a first modification of the wiring layer.

FIG. 5 is a schematic plan view illustrating a first modification of the wiring layer 113.

An example illustrated in FIG. 5 differs from the example illustrated in FIG. 3, in that slits SL are provided to the ground pattern G, thereby defining first ground patterns G1 respectively around the ground clearance regions 151 to 153, and a second ground pattern G2 around the first ground patterns G1 with the slits SL therebetween. The slits SL do not separate the first ground patterns G1 and the second ground pattern G2 completely. Because the first ground patterns G1 and the second ground pattern G2 are partially connected, the patterns G1 and G2 are both supplied with a DC ground potential.

By separating the first ground patterns G1 and the second ground pattern G2 with the slits SL, radiation in a Y1 direction illustrated in FIG. 5 increases, while radiation in a Y2 direction illustrated in FIG. 5 decreases. Accordingly, the gain of the antenna device is increased compared to that with the configuration illustrated in FIG. 3.

Figure 6:
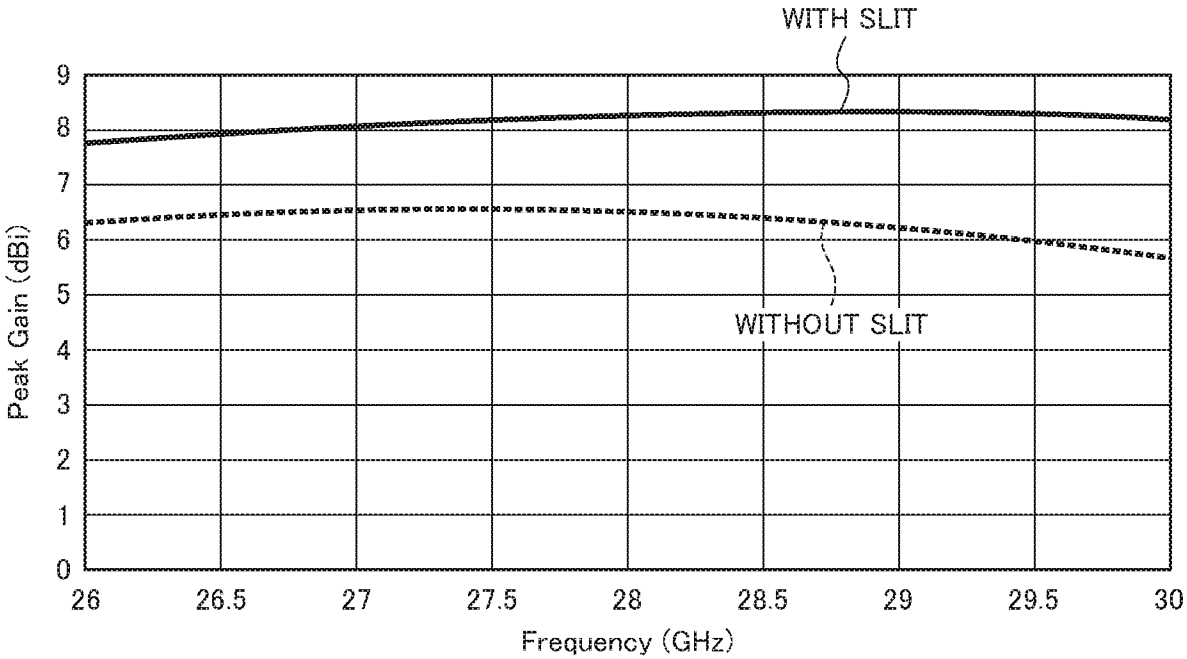
FIG. 6 is a graph illustrating a result of a simulation for describing effects of the slits.

FIG. 6 is a graph illustrating a result of a simulation for describing effects of the slits SL. As illustrated in FIG. 6, it can be seen that the gain in the millimeter band is improved by providing the slits SL.

Figure 7:
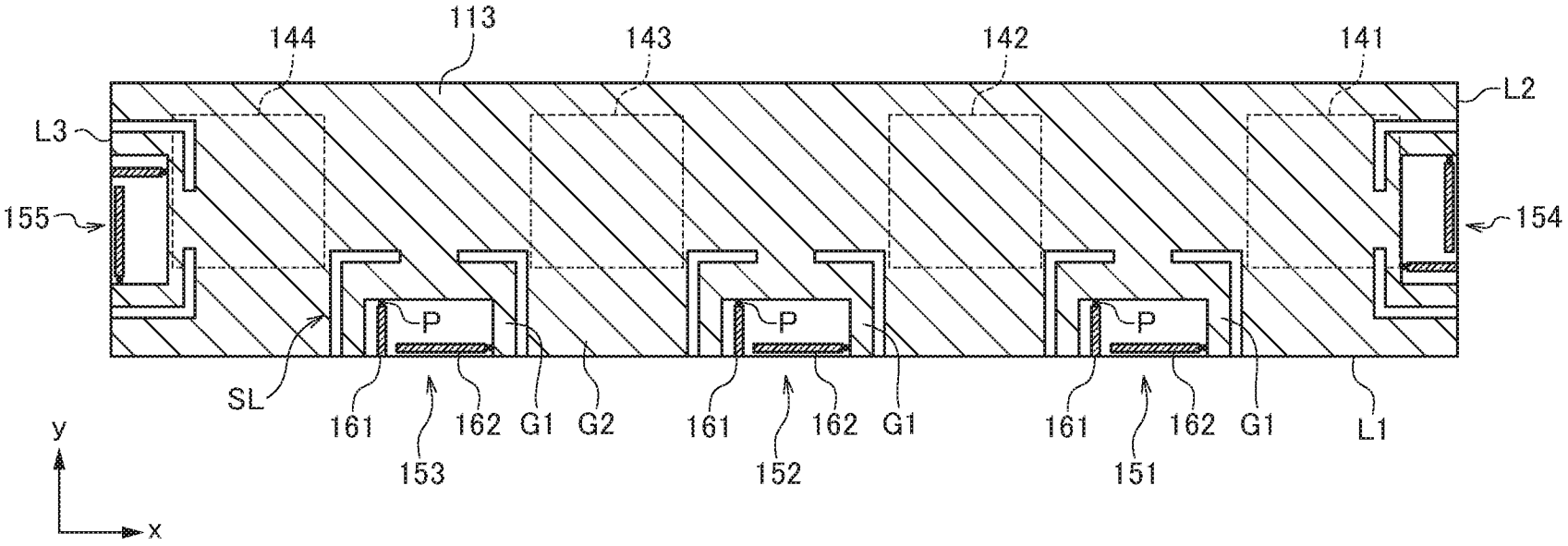
FIG. 7 is a schematic plan view illustrating a second modification of the wiring layer.

FIG. 7 is a schematic plan view illustrating a second modification of the wiring layer 113.

An example illustrated in FIG. 7 differs from the example illustrated in FIG. 5, in that ground clearance regions 154 and 155 are further provided to the ground pattern G. The ground clearance regions 154 and 155 are provided to two ends of the substrate 110 in the x-direction, respectively. That is, the ground clearance region 154 is provided along one short side L2 extending in the y-direction, and the ground clearance region 155 is provided along the other short side L3 extending in the y-direction. In a similar manner to the ground clearance regions 151 to 153, the conductor patterns 161 and 162 are formed inside each of the ground clearance regions 154 and 155, and the slits SL are formed around the ground clearance regions 154 and 155, respectively.

A slot antenna formed in each of the ground clearance regions 154 and 155 functions as a third antenna element that is supplied with power by the IC chip 120 to radiate a beam in the x-direction. Accordingly, beams are radiated not only in the y-direction and the z-direction but also in the x-direction. That is, it is possible to radiate beams in three directions (the x-direction, the y-direction, and the z-direction).

Second Embodiment

Figure 8:
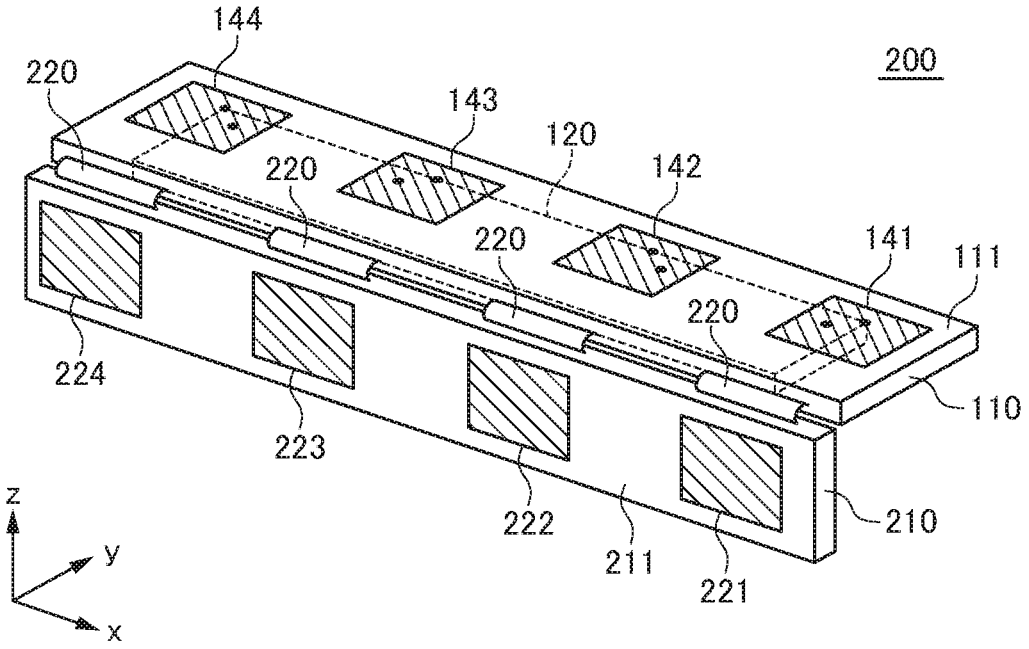
FIG. 8 is a schematic perspective view seen from the top side illustrating a configuration of an antenna device according to a second embodiment of the present invention.
Figure 9:
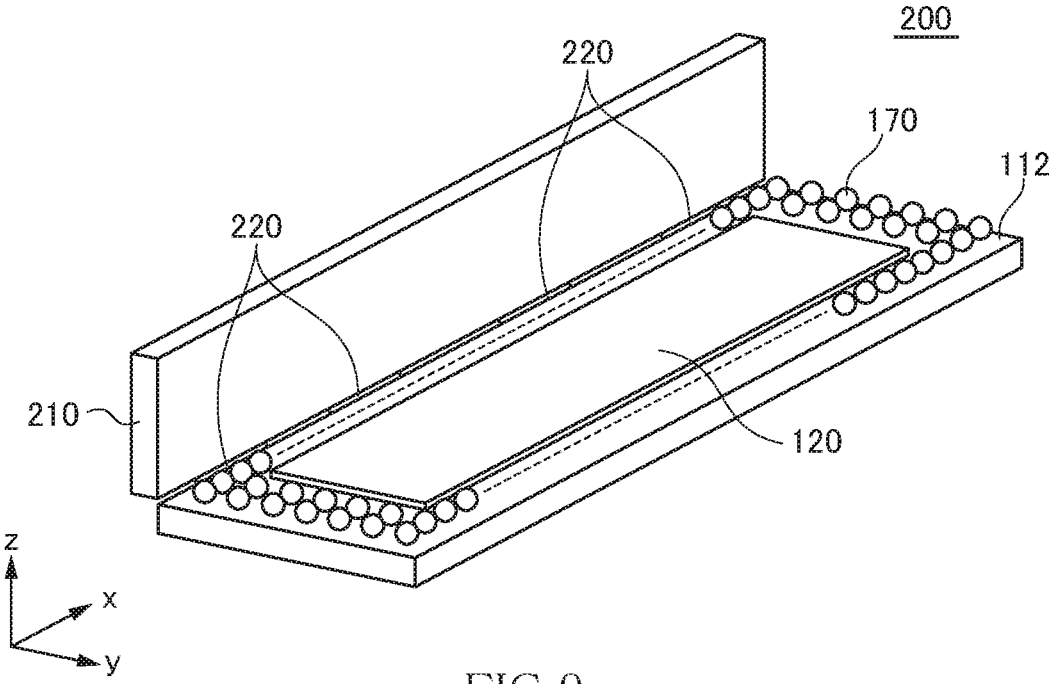
FIG. 9 is a schematic perspective view seen from the bottom side illustrating a configuration of the antenna device according to the second embodiment of the present invention.

FIGS. 8 and 9 are schematic perspective views illustrating a configuration of an antenna device 200 according to the second embodiment of the present invention. FIG. 8 is a view seen from the top side, and FIG. 9 is a view seen from the bottom side.

As illustrated in FIGS. 8 and 9, the antenna device 200 according to the present embodiment includes a substrate 210 and a flexible substrate 220, and differs from the antenna device 100 according to the first embodiment, in that the wiring layer 113 located at the inner layer of the substrate 110 is omitted. Other configurations are the same as those of the antenna device 100 according to the first embodiment. Therefore, like components are denoted by like reference signs and redundant explanations thereof are omitted.

The substrate 210 is connected to the substrate 110 via the flexible substrate 220. Because the flexible substrate 220 connects the substrate 110 and the substrate 210 along a long side extending in the x-direction, it is possible to set the substrate 210 at any angle with respect to the substrate 110, with the x-axis as the center. FIGS. 8 and 9 illustrate a state where the angle between the substrate 110 and the substrate 210 is 90°.

A wiring layer 211 located at the top surface of the substrate 210 is formed with four patch antenna conductors 221 to 224 arrayed in the x-direction. The patch antenna conductors 221 to 224 are supplied with power by the IC chip 120 and function as the second antenna element that radiates a beam in the y-direction. Through phase control of a power supply signal by the IC chip 120, it is possible to incline the beam radiation direction to the x-direction, with the y-axis as the center. The number of patch antenna conductors is not limited to four. However, in order to incline the beam radiation direction to the x-direction, it is necessary to use at least two patch antenna conductors.

Differently from the first embodiment, the flexible substrates 131 and 132 are not used in the present embodiment. Instead, in the wiring layer 112 located on the bottom surface side of the substrate 110, a plurality of external terminals 170 are placed in an array so as to surround the IC chip 120. The external terminals 170 are formed of a solder ball, for example, and are designed to be greater in a height in the z-direction than the IC chip 120.

In this manner, the antenna device 200 according to the present embodiment includes the first antenna element (patch antennas) that radiates beams centered around the z-axis, and the second antenna element (patch antennas) that radiates beams centered around the y-axis. Thus, because beams are radiated in both the z-direction and the y-direction in a similar manner to the first embodiment, it is possible to perform communication over a wider angle, even in the case of using a frequency band in which directionality is required, such as millimeter waves.

Figure 10:
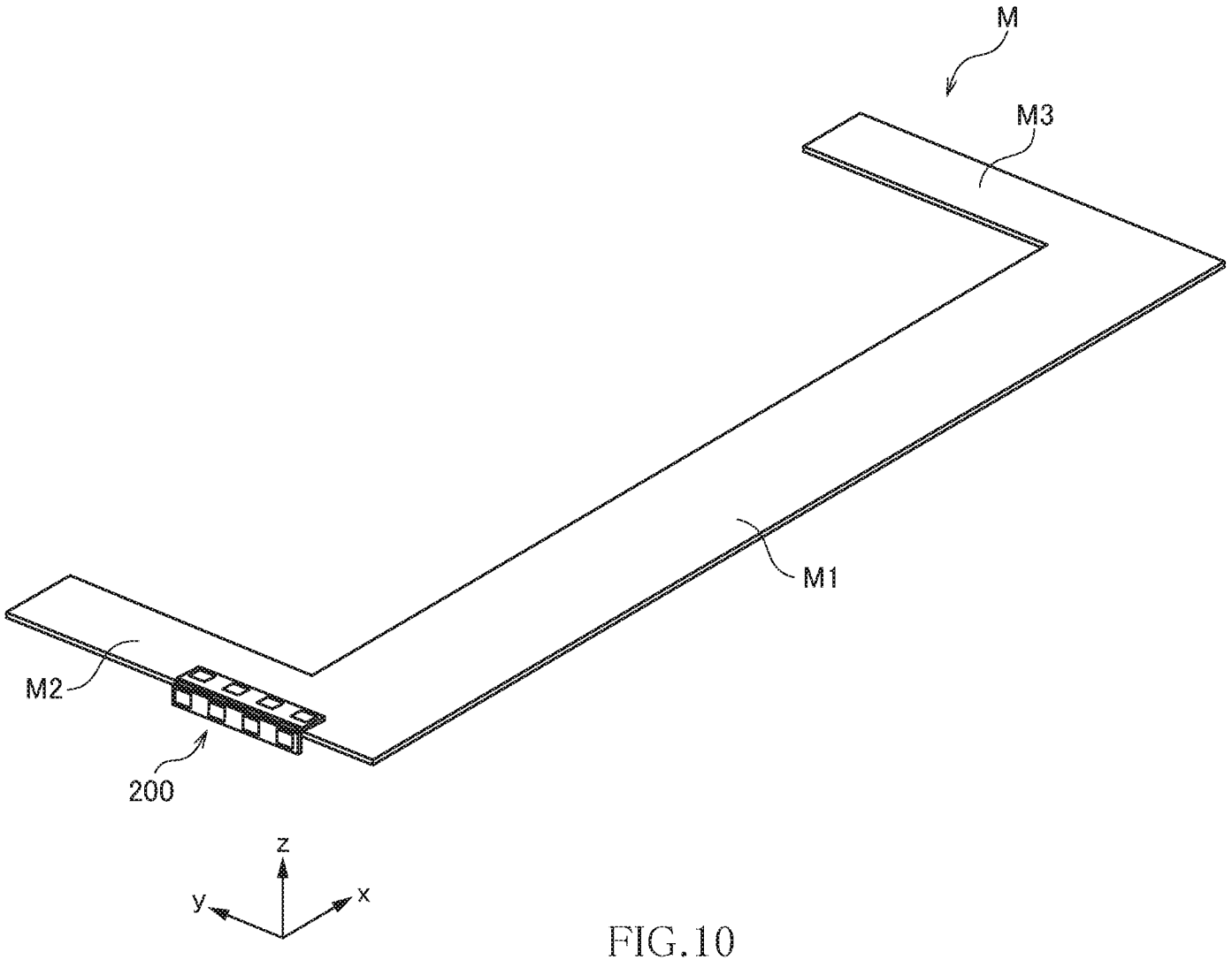
FIG. 10 is a schematic perspective view illustrating a state where the antenna device shown in FIGS. 8 and 9 is connected to the motherboard.

FIG. 10 is a schematic perspective view illustrating a state where the antenna device 200 is connected to the motherboard M. In an example illustrated in FIG. 10, the antenna device 200 is connected to an edge of the second portion M2 of the motherboard M. The antenna device 200 and the motherboard M are connected by connecting a land pattern (not illustrated) provided to the motherboard M and the external terminals 170. Because the IC chip 120 is thinner than the height of the external terminals 170, the IC chip 120 does not interfere with the motherboard M, even when the antenna device 200 is mounted to the motherboard M.

Third Embodiment

Figure 11:
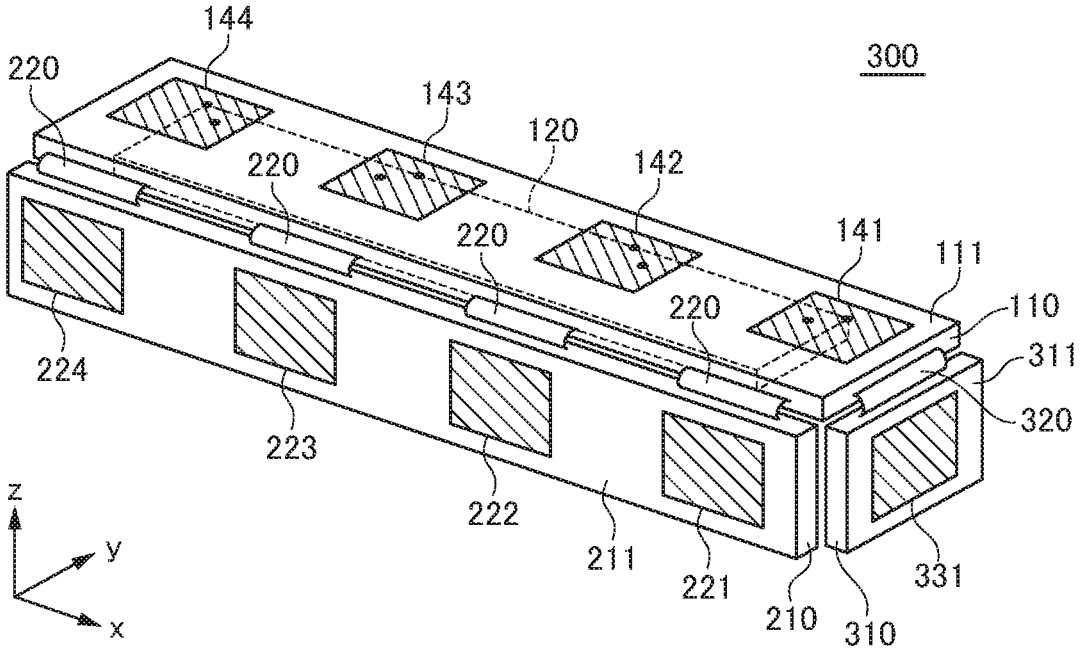
FIG. 11 is a schematic perspective view illustrating a configuration of an antenna device according to a third embodiment of the present invention.

FIG. 11 is a schematic perspective view illustrating a configuration of an antenna device 300 according to the third embodiment of the present invention.

As illustrated in FIG. 11, the antenna device 300 according to the present embodiment differs from the antenna device 200 according to the second embodiment, in including a substrate 310 and a flexible substrate 320. Other configurations are the same as those of the antenna device 200 according to the second embodiment. Therefore, like components are denoted by like reference signs and redundant explanations thereof are omitted.

The substrate 310 is connected to the substrate 110 via the flexible substrate 320. Because the flexible substrate 320 is provided to a short side extending in the y-direction, it is possible to set the substrate 310 at any angle with respect to the substrate 110, with the y-axis as the center. FIG. 11 illustrates a state where the angle between the substrate 110 and the substrate 310 is 90°.

A wiring layer 311 located at the top surface of the substrate 310 is formed with a patch antenna conductor 331. The patch antenna conductor 331 is supplied with power by the IC chip 120 and functions as the third antenna element that radiates a beam in the x-direction. In an example illustrated in FIG. 11, only one patch antenna conductor 331 is formed in the substrate 310. However, two or more patch antenna conductors can be formed.

With the above configuration, beams are radiated not only in the y-direction and the z-direction but also in the x-direction. That is, it is possible to radiate beams in three directions (the x-direction, the y-direction, and the z-direction).

It is apparent that the present invention is not limited to the above embodiments, but may be modified and changed without departing from the scope and spirit of the invention.

What is claimed is:

1. An antenna device comprising:

a substrate having a plurality of wiring layers including a first wiring layer, a second wiring layer, and a third wiring layer having a ground pattern;

an IC chip mounted on the first wiring layer of the substrate;

a first antenna element including a plurality of patch antenna conductors that is supplied with power from the IC chip and that radiates a beam in a first direction substantially perpendicular to the substrate; and a second antenna element that is supplied with power from the IC chip and that radiates a beam second direction substantially parallel to the substrate and substantially perpendicular to the first direction, wherein the first antenna element is formed in the second wiring layer so as to at least partially overlap the IC chip, wherein the second antenna element is configured as a plurality of slot antennas respectively provided within a plurality of ground clearance regions that are cutouts of the ground pattern, wherein each of the ground clearance regions has a first edge extending in the second direction and a second edge extending in a third direction substantially parallel to the substrate and substantially perpendicular to the first and second directions, wherein the ground pattern includes first ground patterns respectively surrounding the ground clearance regions and a second ground pattern surrounding the first ground patterns with slits therebetween, wherein the slits include a plurality of first slits respectively assigned to the ground clearance regions, wherein each of the first slits includes a first section extending in the second direction and a second section extending in the third direction, and wherein each of the first ground patterns has a first area located between the first edge and the first section and a second area located between the second edge and the second section.

2. The antenna device as claimed in claim 1, wherein the patch antenna conductors are arrayed in the third direction.

3. The antenna device as claimed in claim 2, wherein the slot antennas are arrayed in the third direction.

4. The antenna device as claimed in claim 1, further comprising a third antenna element that is supplied with power from the IC chip and that radiates a beam in the third direction.

5. An antenna device comprising:

a substrate having a first wiring layer, a second wiring layer, and a third wiring layer positioned between the first and second wiring layers;

an IC chip mounted on the first wiring layer of the substrate;

a plurality of patch antennas formed on the second wiring layer of the substrate; and a plurality of slot antennas formed on the third wiring layer of the substrate; and a ground pattern formed on the third wiring layer of the substrate, wherein each of the slot antennas is provided within an associated one of ground clearance regions that are cutouts of the ground pattern, wherein each of the slot antennas includes a first conductor pattern extending in a first direction and a second conductor pattern extending in a second direction substantially perpendicular to the first direction, and wherein the ground pattern includes first ground patterns respectively surrounding the ground clearance regions and a second ground pattern surrounding the first ground patterns with slits therebetween.

6. The antenna device as claimed in claim 5, further comprising a flexible substrate on which a connector electrically connected to the IC chip is mounted.

7. An antenna device comprising:

a first substrate on which a plurality of first patch antennas arranged in a first direction are formed;

a second substrate on which a plurality of second patch antennas arranged in the first direction are formed;

a flexible substrate connected to the first and second substrate so as to set the second substrate at any angle with respect to the first substrate with a first direction as a center.

8. The antenna device as claimed in claim 7, wherein the first substrate has a first edge extending in a first direction, wherein the second substrate has a second edge extending in the first direction, and wherein the flexible substrate is connected to the first edge of the first substrate and the second edge of the second substrate.

9. The antenna device as claimed in claim 7, further comprising an IC chip mounted on the first substrate.

10. The antenna device as claimed in claim 9, wherein the IC chip is mounted on a first wiring layer of the first substrate, and wherein the first patch antennas are formed on a second wiring layer of the first substrate different from the first wiring layer so as to overlap with the IC chip.

11. The antenna device as claimed in claim 4, wherein the third antenna element is configured as another slot antenna provided within another ground clearance region that is cutout of the ground pattern.

12. The antenna device as claimed in claim 1, wherein the slits further include a plurality of second slits respectively assigned to the ground clearance regions.

13. The antenna device as claimed in claim 12, wherein each of the ground clearance regions further has a third edge extending in the second direction, wherein each of the second slits includes a third section extending in the second direction and a fourth section extending in the third direction, and wherein each of the first ground patterns further has a third area located between the third edge and the third section and a fourth area located between the second edge and the fourth section.

14. The antenna device as claimed in claim 13, wherein a part of the second edge faces the second ground pattern without an interposition of the slits.

15. The antenna device as claimed in claim 13, wherein each of the slot antennas includes a first conductor pattern extending in the second direction and a second conductor pattern extending in the third direction.

16. The antenna device as claimed in claim 15, wherein the first conductor pattern has a power supply point to which power is supplied from the IC chip and is arranged with an offset to the first edge.

17. The antenna device as claimed in claim 15, wherein the second conductor pattern is connected to the third area of the first ground pattern.

18. The antenna device as claimed in claim 5, wherein the first conductor pattern has a power supply point to which power is supplied from the IC chip, and wherein the second conductor pattern is connected to the first ground pattern.

* * * * *